US009056506B2

(12) United States Patent
Shiota

(10) Patent No.: US 9,056,506 B2
(45) Date of Patent: Jun. 16, 2015

(54) RECORDING APPARATUS AND LIQUID EJECTING APPARATUS

(71) Applicant: SEIKO EPSON CORPORATION, Tokyo (JP)

(72) Inventor: Takayuki Shiota, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/852,113

(22) Filed: Mar. 28, 2013

(65) Prior Publication Data

US 2013/0293634 A1 Nov. 7, 2013

(30) Foreign Application Priority Data

May 7, 2012 (JP) ..... 2012-106170

(51) Int. Cl.
*B41J 23/00* (2006.01)
*B41J 19/20* (2006.01)
*B41J 25/34* (2006.01)

(52) U.S. Cl.
CPC . *B41J 19/20* (2013.01); *B41J 25/34* (2013.01)

(58) Field of Classification Search
CPC ..... B41J 23/00; B41J 25/001
USPC ..... 347/37; 184/18; 384/7, 12, 20, 26, 32, 384/100
See application file for complete search history.

(56) References Cited

U.S. PATENT DOCUMENTS

| | | | | |
|---|---|---|---|---|
| 1,906,727 | A * | 5/1933 | Van Duyn | 184/5 |
| 4,599,006 | A * | 7/1986 | Abel | 384/136 |
| 4,772,899 | A * | 9/1988 | Mamiya et al. | 346/139 R |
| 5,887,994 | A * | 3/1999 | Nomura et al. | 400/352 |
| 7,857,100 | B2 * | 12/2010 | Sakurai | 184/5 |
| 8,375,815 | B2 * | 2/2013 | Miyahara et al. | 74/89.44 |
| 2002/0033874 | A1 * | 3/2002 | Aubin et al. | 347/197 |
| 2009/0038887 | A1 * | 2/2009 | Hwang et al. | 184/5 |

FOREIGN PATENT DOCUMENTS

| | | |
|---|---|---|
| JP | 2001-277637 | 10/2001 |
| JP | 2006-082379 | 3/2006 |
| JP | 2007-186309 | 7/2007 |

* cited by examiner

*Primary Examiner* — Alessandro Amari
*Assistant Examiner* — Michael Konczal
(74) *Attorney, Agent, or Firm* — Workman Nydegger

(57) ABSTRACT

A recording apparatus includes a carriage which includes a recording head performing recording on a medium and is movable in a first direction; a shaft-shaped guide shaft which guides the carriage in the first direction and extends in the first direction; and a lubricant guiding unit which guides a lubricant to a sliding contact portion between the carriage and the guide shaft, wherein the lubricant guiding unit includes a cylindrical member which is loosely fitted on outside the guide shaft and the cylindrical member is rotated when the carriage is moved.

8 Claims, 8 Drawing Sheets

RECORDING APPARATUS AND LIQUID EJECTING APPARATUS

BACKGROUND

1. Technical Field

The present invention relates to a recording apparatus including a carriage which has a recording head performing recording on a medium and a guide member guiding the carriage in a moving direction thereof. In addition, the invention relates to a liquid ejecting apparatus ejecting liquid from a liquid ejecting head onto a liquid ejected material.

Here, the liquid ejecting apparatus includes an apparatus in which a liquid ejecting head corresponding to the ink jet type recording head is used, liquid corresponding to its application instead of ink ejected from the liquid ejecting head onto a liquid ejected medium corresponding to the recorded medium and the liquid is attached to the liquid ejected medium.

In addition, the liquid ejecting head includes a color material ejecting head which is used in manufacturing a color filter such as a liquid crystal display, an electrode material (a conductive paste) ejecting head which is used in forming the electrode of an organic EL display, field emission display (FED) or the like, a bioorganic matter ejecting head which is used in manufacturing a biochip, a sample ejecting head as a precision pipette or the like as well as the above described recording head.

2. Related Art

An ink jet printer that is an example of a recording apparatus or a liquid ejecting apparatus is configured such that the ink is ejected from the recording head onto the recorded material while a carriage on which a recording head is mounted is reciprocated in the main scanning direction and then the recording is performed. Generally, the reciprocation of the carriage is performed by transmitting power from a driving motor as a driving source to the carriage via an endless belt. The carriage is reciprocated by being guided by a carriage guide shaft in an axial direction (a main scanning direction) via a sliding bearing (for example, JP-A-2001-277637 and JP-A-2006-82379).

Since the sliding bearing of the carriage slides relative to the carriage guide shaft, grease or the like as a lubricant is applied on the guide shaft in order to smooth the sliding thereof.

However, the sliding contact between the bearing of the carriage and the carriage guide shaft does not come into contact with each other in an entire circumference thereof. The sliding contact portion between the bearing of the carriage and the carriage guide shaft comes into sliding contact with each other at a portion which includes an inclined upper position shifted from directly above the carriage guide shaft due to action of the weight of the carriage and due to a driving action to the carriage by a moving unit. Then, when the operation of the carriage is repeated, there is a concern that the lubricant of the sliding contact portion is gradually lost, vibration resistance is increased and durability, noise and vibration may be caused.

SUMMARY

An advantage of some aspects of the invention is to provide a recording apparatus and a liquid ejecting apparatus in which a lubricant may be preferably present at a sliding contact portion between a bearing of a carriage and the guide member.

According to a first aspect of the invention, there is provided a recording apparatus including: a carriage which includes a recording head performing recording on a medium and is movable in a first direction; a shaft-shaped guide shaft which guides the carriage in the first direction and extends in the first direction; and a lubricant guiding unit which guides a lubricant to a sliding contact portion between the carriage and the guide shaft, wherein the lubricant guiding unit includes a cylindrical member which is loosely fitted on outside the guide shaft and the cylindrical member is rotated when the carriage is moved.

In this case, the lubricant can be supplied effectively to the sliding contact portion by the lubricant guiding unit which guides the lubricant to the sliding contact portion, specifically, by the cylindrical member which is rotated for each movement of the carriage and the lubricant can be present preferably at the sliding contact portion even though the lubricant is gradually lost from the sliding contact portion according to the moving operation of the carriage. As a result, the increase of the load of the sliding contact portion can be avoided and the improvement of the durability can be realized.

According to the aspect, the sliding contact portion may be in an upper region of the guide shaft, the cylindrical member may have a hole passing through in a radial direction thereof, and the hole may be directed from a lower side to an upper side of the guide shaft and may reach the sliding contact portion due to the rotation of the cylindrical member.

In this case, since the cylindrical member has the hole passing through the cylindrical member in the radial direction, the hole is directed from the lower side to the upper side of the guide shaft and reaches the sliding contact portion by the rotation of the cylindrical member, the lubricant accumulated in the lower side can be effectively guided to the sliding contact portion of the upper side thereof. In addition, the lubricant is accumulated in the hole and the lubricant can be supplied further effectively to the sliding contact portion.

According to the aspect, the position of the hole in the circumferential direction of the guide shaft may be in the position of the sliding contact portion or the periphery thereof, when the cylindrical member is in a rotation limit position. In this case, the lubricant accumulated in the hole can be accumulated at the position of the sliding contact portion for a long time and the lubricant can be supplied effectively to the sliding contact portion.

According to the aspect, the carriage may have a pair of bearings which are engaged with the guide shaft and the cylindrical member may be disposed between the pair of bearings.

According to the aspect, the carriage may include a storage chamber storing the cylindrical member so that the cylindrical member is movable in a certain stroke in the first direction. In this case, since the cylindrical member is accumulated in the storage chamber, it can suppress the lubricant from being scattered according to the rotation of the cylindrical member.

According to the aspect, the cylindrical member may have a slit extending in a direction across an axis of the guide shaft, the carriage may have a protrusion entering the slit, and the protrusion may rotate the cylindrical member via the slit according to the movement of the carriage. In this case, the cylindrical member can be rotated according to the movement of the carriage with a simple structure.

According to a second aspect of the invention, there is provided a liquid ejecting apparatus including: a carriage which includes a liquid ejecting head performing liquid ejecting on a medium and is movable in a first direction; a shaft-shaped guide shaft which guides the carriage in the first direction and extends in the first direction; and a lubricant guiding unit which guides a lubricant to a sliding contact portion between the carriage and the guide shaft, wherein the lubricant guiding unit includes a cylindrical member which is loosely fitted on outside the guide shaft and the cylindrical member is rotated when the carriage is moved.

In this case, similar to the first aspect, the lubricant can be supplied effectively to the sliding contact portion by the lubricant guiding unit which guides the lubricant to the sliding contact portion, specifically, by the cylindrical member which is rotated for each movement of the carriage and the lubricant can be present preferably at the sliding contact portion even though the lubricant is gradually lost from the sliding contact portion according to the moving operation of the carriage. As a result, the increase of the load of the sliding contact portion can be avoided and the improvement of the durability can be realized.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
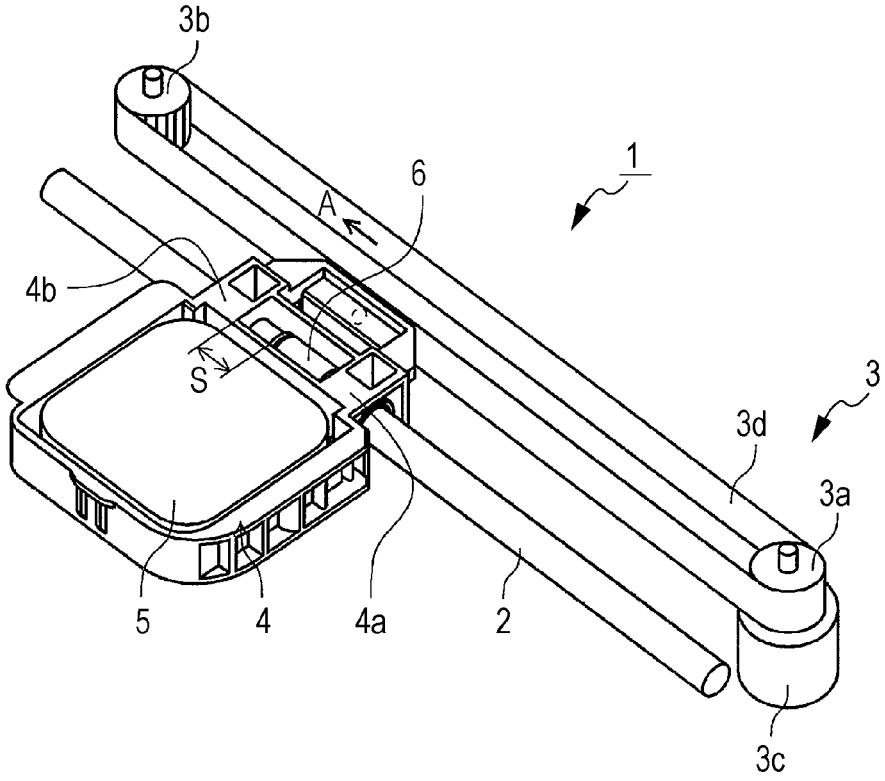
FIG. 1 is a perspective view illustrating a main portion of a printer as a recording apparatus or a liquid ejecting apparatus according to the invention.

Hereinafter, an embodiment of the invention will be described, based on the drawings. The invention is not limited to the embodiment described below and can be modified variously within a range of the invention described in the claims. An embodiment of the invention will be described, based on the drawing, assuming that the modifications are intended to be included in the range of the invention.

Figure 2:
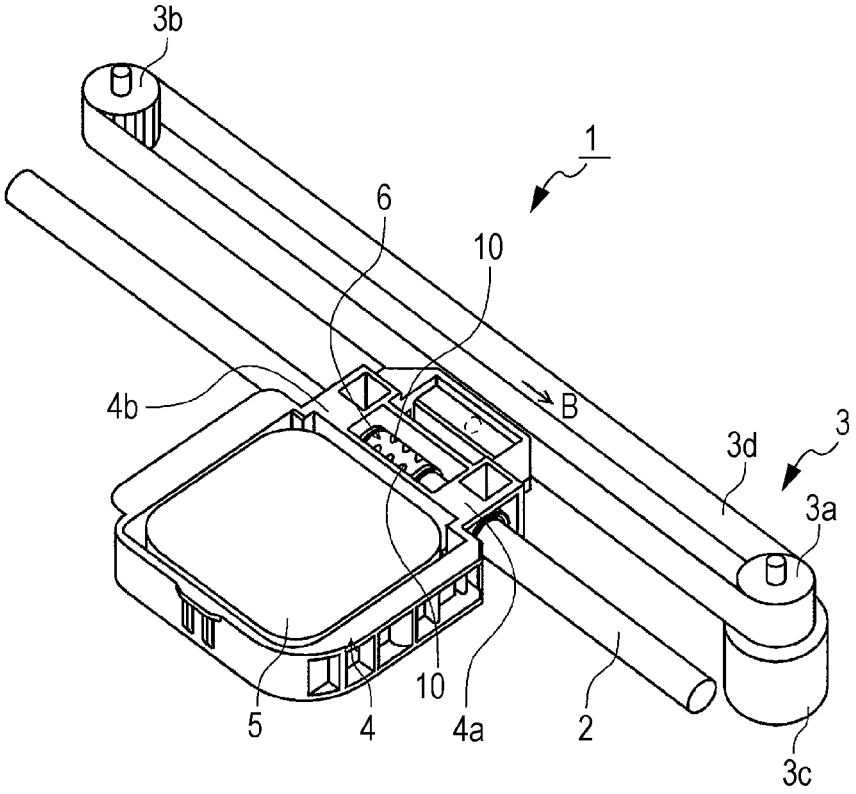
FIG. 2 is a perspective view illustrating another operation state of the printer in FIG. 1.
Figure 3:
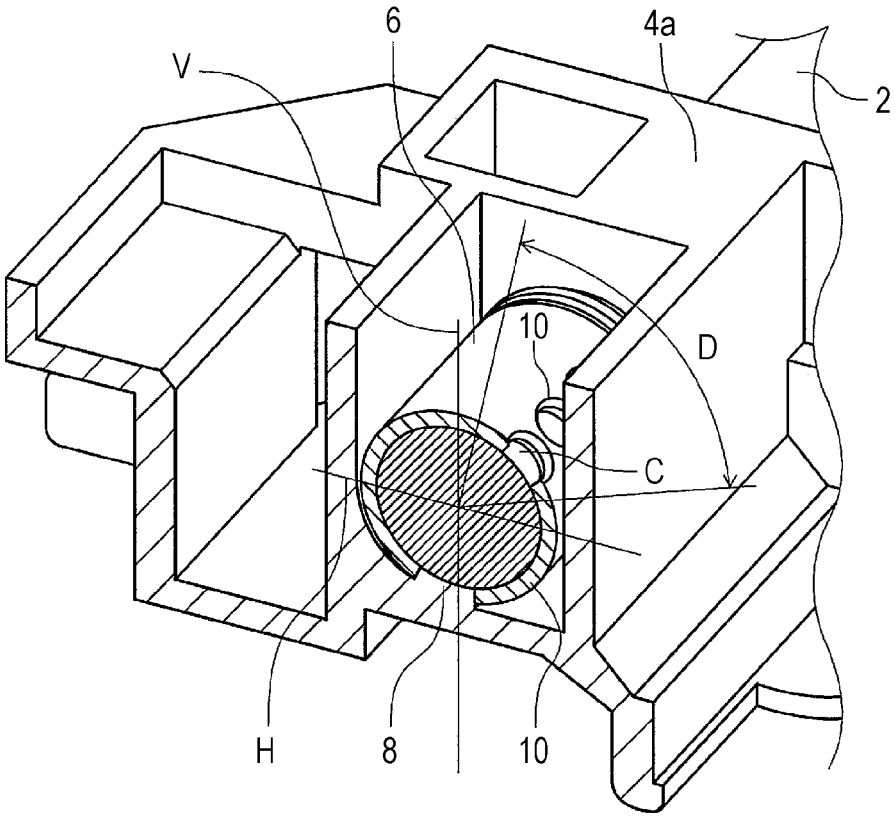
FIG. 3 is a perspective view illustrating a cross-section of a main portion of the printer in FIG. 1.
Figure 4:
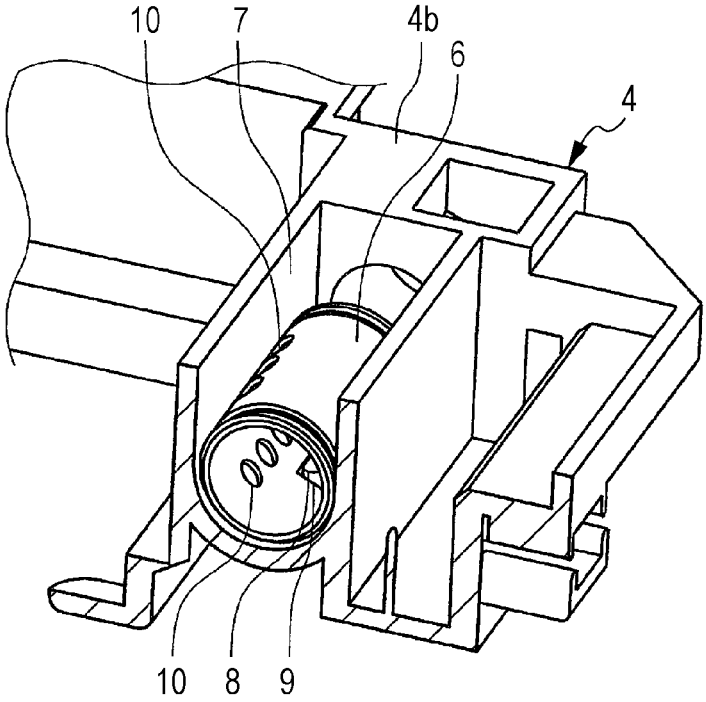
FIG. 4 is a perspective view of one operation state illustrating a structure of a main portion of the printer in FIG. 1.
Figure 5:
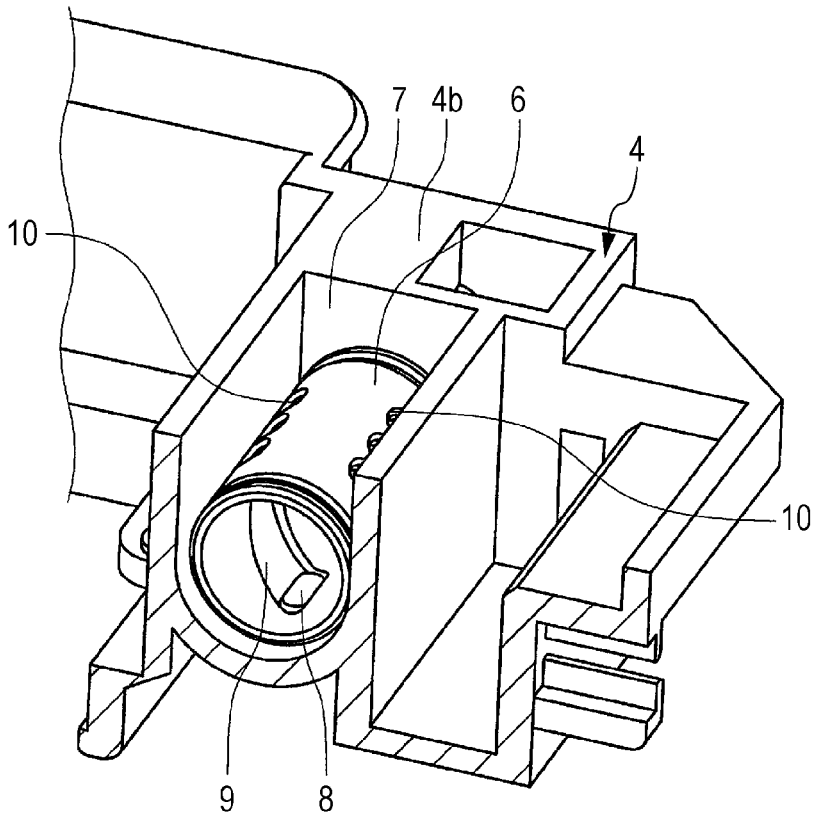
FIG. 5 is a perspective view of another operation state illustrating a main portion structure of the printer in FIG. 1.
Figure 6:
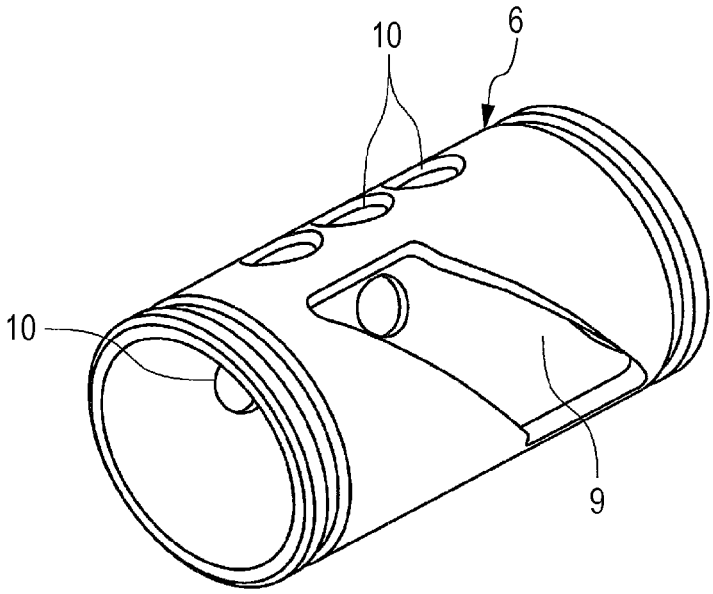
FIG. 6 is a perspective view of the cylindrical member of a configuration element of the printer in FIG. 1.

FIGS. 1 and 2 are perspective views of a main portion of an ink jet type printer (hereinafter, referred to as "a printer") 1 that is an embodiment of "a recording apparatus" or "a liquid ejecting apparatus" according to the invention.

The printer 1 includes a recording head (not illustrated) (an example of a liquid ejecting head) as a main configuration element of a recording performance unit (an example of a liquid ejecting performance unit) which performs the recording on a paper as an example of a medium, at a lower surface of a carriage 4. The carriage 4 is guided by a carriage shaft 2 as "a guide member" and is reciprocated in a direction opposite to a first direction (a main scanning direction along a paper width) by a moving unit 3.

A carriage guide shaft 2 is formed from a circular tube material or a cylindrical body made of a stainless steel and of which both ends are fixed to a body frame (not illustrated).

The carriage 4 has a pair of slide bearings 4*a* and 4*b* through which the carriage guide shaft 2 is passed, and an ink tank 5 storing ink to supply the ink (an example of an ejecting liquid) to a recording head (not illustrated) included in a lower surface portion thereof.

The moving unit 3 has two pulleys 3*a* and 3*b* provided on positions corresponding to both ends of the carriage guide shaft 2, a controlling motor 3*c* which drives and rotates one pulley 3*a* and an endless belt 3*d* which is wound between two pulleys 3*a* and 3*b*. The endless belt 3*d* is connected and fixed to the carriage 4.

Then, the printer 1 includes a cylindrical member 6 illustrated in FIGS. 3 to 6 as a lubricant guiding unit for guiding lubricant on a sliding contact portion from a periphery of the sliding contact portion between the slide bearings 4*a* and 4*b* of the carriage 4 and the carriage guide shaft 2.

The carriage 4 includes a pair of the slide bearings 4*a* and 4*b*, the cylindrical member 6 and a storage chamber 7. The pair of the slide bearings 4*a* and 4*b* are provided on positions separated from each other in an axial direction of the carriage guide shaft 2. The cylindrical member 6 is engaged and guided by the carriage guide shaft 2 via the pair of the slide bearings 4*a* and 4*b* and is loosely fitted to the outside of the carriage guide shaft 2 between the pair of the slide bearings 4*a* and 4*b*. The storage chamber 7 is connected between the pair of the bearings 4*a* and 4*b*, and forms a space having a substantially U-shaped cross-section to store the cylindrical member 6.

Then, a distance between the pair of the slide bearings 4*a* and 4*b* is set to be greater than a length of the cylindrical member 6 so that the cylindrical member 6 is movable only by a certain stroke S (FIGS. 1 and 2).

Thus, the cylindrical member 6 has a gap dimension S from the slide bearing 4*b* which is a front side in the moving direction thereof when the carriage 4 is moved in a first direction (for example, an arrow direction A in FIG. 1: a main scanning direction along a width direction of the paper). In addition, the cylindrical member 6 is moved by being pressed by the slide bearing 4*a* which is a rear side in the moving direction thereof.

Then, the gap between the cylindrical member 6 and the slide bearing 4*b* becomes the rear side in the moving direction with respect to the cylindrical member 6 when the carriage 4 reaches a movement end and then the moving direction is reversed to the opposite direction thereof (an arrow direction B in FIG. 2). When the reverse movement is performed, the gap of the rear side in the moving direction becomes small according to the start of the movement of the carriage 4. A gap is generated in the front side in the moving direction with respect to the cylindrical member 6. As illustrated in FIG. 2, when the gap of the rear side in the moving direction is not present, the cylindrical member 6 is moved by being pressed by the slide bearing 4*b* of the rear side in the moving direction.

Accordingly, when the carriage 4 reaches the movement end and then starts the movement in the reverse direction, the cylindrical member 6 strokes with respect to the carriage 4 by the gap dimension S. In this case, a protrusion 8 provided on a bottom surface of the storage chamber 7 and a spiral slit 9 provided on the cylindrical member 6 are engaged with each other and then the spiral slit 9 has a sliding angle with respect to the protrusion 8. Accordingly, the cylindrical member 6 is rotated around the carriage guide shaft 2 when the cylindrical member 6 strokes with respect to the carriage 4 by the gap dimension S.

Since the cylindrical member 6 strokes with respect to the carriage 4 in both directions, the cylindrical member 6 is rotated around the carriage guide shaft 2 in both directions. In the embodiment, a center angle of the cylindrical member 6 corresponding to the distance from one end of the spiral slit 9 in the circumferential direction to the other end thereof is set so that the rotation angle is 90 degrees. The cylindrical member 6 may be set to rotate 1 to 3 times by increasing the distance between the slide bearings and by extending the screw of the spiral slit 9.

Then, a plurality (three in the view) of holes 10 are provided at positions having intervals of 90 degrees in the circumferential direction along the axial direction in the cylindrical member 6. The plurality of the holes 10 have a positional relationship to be substantially horizontal symmetrical when the cylindrical member 6 rotates by 90 degrees in one direction and stops (for example, a state illustrated in FIG. 7). In addition, the plurality of the holes 10 have a positional relationship to be substantially vertical symmetrical when the cylindrical member 6 rotates by 90 degrees in another direction and stops (for example, a state illustrated in FIG. 8). A straight line H is a horizontal line and a straight line V is a vertical line in FIGS. 3, 8 and 9.

Here, a sliding contact portion C between the carriage guide shaft 2 and the slide bearings 4*a* and 4*b* is not directly above the carriage guide shaft 2 and in the embodiment, is positioned shifted approximately 45 degrees from directly above the carriage guide shaft 2. Since the weight of the carriage 4 is applied directly above the carriage guide shaft 2, originally, it is supposed that the sliding contact portion C is positioned directly above the carriage guide shaft 2. However, the carriage 4 receives a driving force from the endless belt 3*d* and is likely to rotate inside the horizontal plane so that the sliding contact portion C is not positioned directly above the carriage guide shaft 2 by the influence and is positioned at a location which is slightly skewed from the directly above the carriage guide shaft 2.

Figure 7:
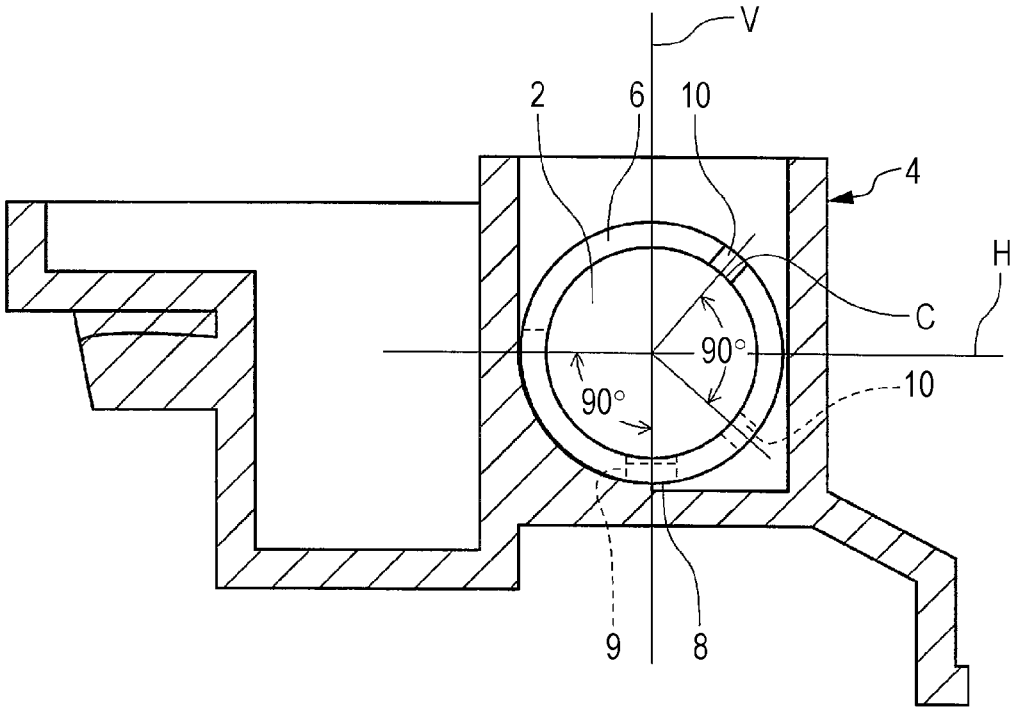
FIG. 7 is a cross-sectional view of a main portion of one operation state of the printer in FIG. 1.
Figure 8:
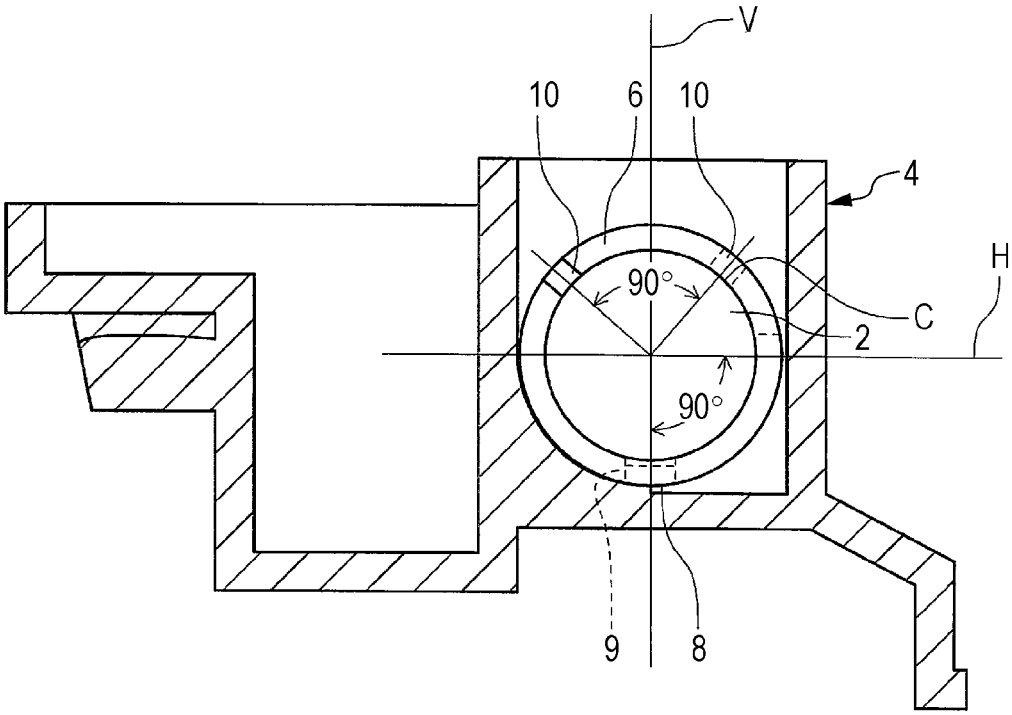
FIG. 8 is a cross-sectional view of a main portion of another operation state of the printer in FIG. 1.

Thus, in the embodiment, the positions of the holes 10 approximately accord with the sliding contact portion C in the circumferential direction of the carriage guide shaft 2 in FIGS. 7 and 8. Then, the hole 10 has a bore in which lubricating oil that is an example of the lubricant is accumulated by the surface tension. The hole 10 has a function to introduce and hold the lubricating oil, and to guide the lubricating oil inside thereof. In addition, the sliding contact portion C may be in a position different from the embodiment due to the weight of the carriage 4, the driving force to the carriage 4 or the like.

Sequentially, action thereof will be described. The sliding contact portion C is in a position which is shifted from directly above the carriage guide shaft 2 and the slide bearings 4*a* and 4*b* slide and cut the lubricant in the sliding contact portion C of the carriage guide shaft 2 for each movement of the carriage 4 so that the coating of the lubricant of the sliding contact portion C is gradually thin and sliding resistance (load) is increased. Accordingly, there is a concern that noise, vibration or the like may be caused when the coating of the lubricant is too thin.

However, according to the embodiment, the cylindrical member 6 is provided which is a guiding unit of the lubricant from the periphery of the sliding contact portion C between the carriage 4 and carriage guide shaft 2 to the sliding contact portion C. In addition, the cylindrical member 6 is rotated in one direction when the carriage 4 is moved in a first direction (the main scanning direction along the width direction of the paper) and is rotated in the opposite direction when the carriage 4 is moved in the opposite direction. As described above, the lubricating oil is actively guided from the periphery of the sliding contact portion C to the sliding contact portion C by the rotation of the cylindrical member 6 so that the increase of the load in the sliding contact portion C can be avoided and improvement of the durability can be realized.

In addition, the holes 10 formed on the cylindrical member 6 accumulate the lubricating oil and guide the lubricating oil inside the cylindrical member 6. The hole 10 is directed from the lower side to the upper side of the carriage guide shaft 2 by the rotation of the cylindrical member 6 and the hole 10 reaches the sliding contact portion C. Accordingly, the lubricating oil can be guided further effectively to the sliding contact portion C. In addition, even if there is no hole 10, the inner periphery surface of the cylindrical member 6 performs a function to stretch the lubricating oil in the circumferential direction of the carriage guide shaft 2 so that the lubricating oil can be actively supplied to the sliding contact portion C.

In addition, in the embodiment, since the position of the hole 10 in the circumferential direction of the carriage guide shaft 2 substantially accords with the position of the sliding contact portion C when the cylindrical member 6 is in a rotation limit position (the state illustrated in FIG. 7 or FIG. 8), the lubricating oil accumulated in the hole 10 can be accumulated in the position of the sliding contact portion C for a long time and the lubricating oil can be supplied effectively to the sliding contact portion C.

Furthermore, since the cylindrical member 6 includes the storage chamber 7 which stores the cylindrical member 6 so as to be movable in a certain stroke S in the main scanning direction, it can be suppressed that the lubricating oil is scattered around thereof according to the rotation of the cylindrical member 6. In addition, when the lubricating oil is accumulated in the bottom portion of the storage chamber 7, the hole 10 scoops up the lubricating oil accumulated in the bottom portion and then the lubricating oil can be further effectively supplied to the sliding contact portion C.

In addition, when a clearance between the outer periphery of the carriage guide shaft 2 and the inner periphery of the cylindrical member 6 is too narrow, the operation load of the carriage 4 is increased due to shear resistance of the oil film. In addition, conversely, if the clearance is too large, the lubricating oil cannot be supplied to the sliding contact portion C. Thus, it is preferable that the clearance be set appropriately considering the viscosity of the lubricating oil.

In addition, in the above embodiment, the cylindrical member 6 is formed from a resin material. However, it is also preferable that for example, the cylindrical member 6 may be formed from a material (for example, a felt material) which can hold the lubricant.

The entire disclosure of Japanese Patent Application No. 2012-106170, filed May 7, 2012 is expressly incorporated by reference herein.

What is claimed is:

1. A recording apparatus comprising:

a carriage which includes a recording head performing recording on a medium and is movable in a first direction and a second direction that is opposite the first direction, the carriage forming a lubricant storing storage chamber;

a smoothed surfaced shaft-shaped guide shaft which guides the carriage in the first and second directions and extends in the first direction;

a pair of slide bearings which are arranged on the guide shaft in the carriage, and which are separated from each other in an axial direction of the guide shaft; and a lubricant guiding unit which is arranged on the guide shaft between the pair of slide bearings and which guides a lubricant to a sliding contact portion between the carriage and the guide shaft, wherein the carriage slides on the shaft-shaped guide shaft via the pair of slider bearings, wherein the lubricant guiding unit includes a cylindrical member which is loosely fitted on outside the guide shaft and within the lubricant storing storage chamber and the cylindrical member engages with a portion of the carriage and is rotated when the carriage is moved and an outer surface of the cylindrical member collects lubricant accumulated in the lubricant storing storage chamber.

2. The recording apparatus according to claim 1, wherein the sliding contact portion is in an upper region of the guide shaft, wherein the cylindrical member has a hole passing through in a radial direction thereof, and wherein the hole is directed from a lower side to an upper side of the guide shaft and reaches the sliding contact portion due to the rotation of the cylindrical member.

3. The recording apparatus according to claim 2, wherein the position of the hole is in the position of the sliding contact portion or the periphery thereof in the circumferential direction of the guide shaft, when the cylindrical member is in a rotation limit position.

4. The recording apparatus according to claim 1, wherein the carriage has a pair of bearings which are engaged with the guide shaft, and wherein the cylindrical member is disposed between the pair of the bearings.

5. The recording apparatus according to claim 4, wherein the cylindrical member is movable in a certain stroke in the first direction.

6. The recording apparatus according to claim 5, wherein the cylindrical member has a slit extending in a direction across an axis of the guide shaft, wherein the carriage has a protrusion entering the slit, the protrusion being the portion of the carriage engaging with the cylindrical member, and wherein the protrusion rotates the cylindrical member via the slit according to the movement of the carriage.

7. The recording apparatus according to claim 6, wherein the slit has a sliding angle with respect to the protrusion.

8. The recording apparatus according to claim 1, wherein the outer surface of the cylindrical member is formed in plane surface.

* * * * *